US009607604B2

(12) United States Patent
Kim

(10) Patent No.: US 9,607,604 B2
(45) Date of Patent: Mar. 28, 2017

(54) ACTIVE NOISE CONTROL APPARATUS FOR VEHICLE

(71) Applicant: Hyundai Mobis Co., Ltd., Seoul (KR)

(72) Inventor: Yun Sung Kim, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 41 days.

(21) Appl. No.: 14/726,027

(22) Filed: May 29, 2015

(65) Prior Publication Data

US 2016/0086593 A1 Mar. 24, 2016

(30) Foreign Application Priority Data

Sep. 19, 2014 (KR) ..... 10-2014-0124978

(51) Int. Cl.
*G10K 11/16* (2006.01)
*G10K 11/178* (2006.01)

(52) U.S. Cl.
CPC ..... *G10K 11/1784* (2013.01); *G10K 2210/12821* (2013.01); *G10K 2210/3214* (2013.01); *G10K 2210/3226* (2013.01)

(58) Field of Classification Search
CPC ..... H04R 2499/13; H04R 5/027; H04R 5/04; H04R 2420/03; H04B 1/082; H04B 1/1083; H04B 7/269; G10K 11/175; G10K 2210/1282; G10K 2210/12821; G10K 2210/128
USPC ..... 381/71.1, 71.4, 86
See application file for complete search history.

(56) References Cited

U.S. PATENT DOCUMENTS 5,384,853 A * 1/1995 Kinoshita ..... G10K 11/1786 381/71.12
2009/0205903 A1 8/2009 Evert et al.
2012/0076319 A1* 3/2012 Terwal ..... G06F 17/3074 381/86

FOREIGN PATENT DOCUMENTS

| | | |
|---|---|---|
| JP | 09-230874 | 9/1997 |
| JP | 11-341591 | 12/1999 |
| JP | 2009-130693 | 6/2009 |
| KR | 10-2007-0093519 | 9/2007 |
| KR | 10-2008-0091438 | 10/2008 |

* cited by examiner

*Primary Examiner* — Md S Elahee
*Assistant Examiner* — Sabrina Diaz
(74) *Attorney, Agent, or Firm* — H.C. Park & Associates, PLC

(57) ABSTRACT

An active noise control apparatus for a vehicle including: a plurality of microphones each configured to receive noise generated in the vehicle and generate an electrical signal corresponding to the noise; an external amplifier configured to supply power required for operations of the plurality of microphones; and a head unit configured to control the external amplifier to output a signal for removing the noise, based on the electrical signals generated from the plurality of microphones.

7 Claims, 6 Drawing Sheets

ACTIVE NOISE CONTROL APPARATUS FOR VEHICLE

CROSS-REFERENCES TO RELATED APPLICATION

The present application claims priority from and the benefit of Korean application number 10-2014-0124978, filed on Sep. 19, 2014, which is incorporated by reference for all purposes as if fully set forth herein.

BACKGROUND

Field

Exemplary embodiments relate to an active noise control apparatus for a vehicle, and more particularly, to an active noise control apparatus for a vehicle, which is capable of expanding the number of microphones regardless of the number of external amplifiers, thereby effectively collecting and removing noise generated in the vehicle.

Discussion of the Background

In general, a vehicle includes a large number of devices installed therein. Recently, devices for a driver's or passenger's convenience have been steadily developed and installed in vehicles. Representative examples of the devices may include an audio system or air conditioning system. Furthermore, more and more vehicles are employing a navigation system installed therein, the navigation system recognizing the location of a vehicle through a satellite or the like and guiding the vehicle to the destination.

Recently, a technology for removing noise generated in a vehicle through an audio system has been developed.

The noise within the vehicle may be generated as a result of sound of an engine or sound of a wind introduced during operation of the vehicle. Furthermore, the noise may be generated while the vehicle travels on an uneven road.

In general, a method for reducing such noise includes a passive noise control method which reduces noise through a sound absorbing material installed in the vehicle, and an active noise control method which reduces a noise signal by outputting a control signal having a phase opposite that of the noise signal.

According to the recent trend, more and more consumers want to purchase a more comfortable and quiet vehicle. Thus, much attention has been paid to the active noise control method, which exhibits a more excellent effect than the passive noise control method, when reducing low-frequency noise, such as engine noise, generated by the vehicle.

An active noise control apparatus which is generally employed in a vehicle includes a microphone, a DSP module, an amplifier, and a speaker. The microphone detects noise, the DSP module includes an adaptive digital filter and a signal controller so as to invert the phase of the detected noise, the amplifier amplifies the phase-inverted noise, and the speaker plays the amplified noise.

Furthermore, the active noise control apparatus generates an artificial sound having the same magnitude as, but the opposite phase to, noise introduced into the vehicle, and superposes the two signals to attenuate or remove the noise.

The related art of the present invention is disclosed in Korean Patent Laid-open Publication No. 10-2008-0091438, published on Oct. 13, 2008, and entitled "Active noise control method and system for a vehicle".

The number of microphones included in the conventional active noise control apparatus is determined according to the performance of target noise control and a position in the vehicle. In general, two to four microphones are included.

At this time, in order to collect various noise sources in the vehicle, the number of microphones mounted in the vehicle needs to be increased.

However, because the microphones included in the conventional active noise control apparatus are directly connected to an external amplifier, installation of an additional microphone may not be possible. Furthermore, as the number of microphones is increased, the length and weight of a wiring harness for connecting the external amplifier to the microphones are inevitably increased.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide an active noise control apparatus for a vehicle, which connects microphones and an external amplifier in series to each other so as to expand the number of microphones regardless of the number of external amplifiers, thereby effectively collecting and removing noise generated in the vehicle.

Exemplary embodiments also provide an active noise control apparatus for a vehicle, in which microphones and an external amplifier exchange signals to reduce a voltage drop which can occur in the microphones, thereby improving current efficiency and power stability.

Additional aspects will be set forth in the detailed description which follows, and, in part, will be apparent from the disclosure, or may be learned by practice of the inventive concept.

An exemplary embodiment discloses an active noise control apparatus for a vehicle including: a plurality of microphones, each configured to receive noise generated in the vehicle and generate an electrical signal corresponding to the noise; an external amplifier configured to supply power required for operation of the microphones; and a head unit configured to control the external amplifier to output a signal for removing the noise, based on the electrical signals generated from the microphones.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
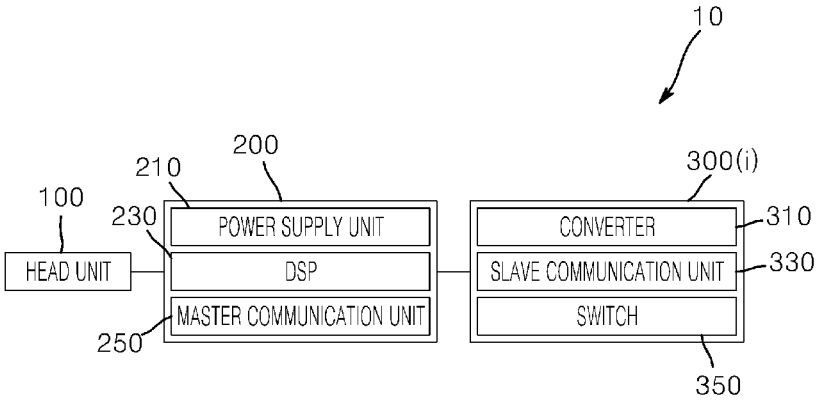
FIG. 1 is a functional block diagram of an active noise control apparatus for a vehicle in accordance with an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

FIG. 1 is a functional block diagram of an active noise control apparatus 10 for a vehicle in accordance with an exemplary embodiment of the present invention.

Referring to FIG. 1, the active noise control apparatus 10 for a vehicle in accordance with an exemplary embodiment of the present invention may include a head unit 100, an external amplifier 200, and a plurality of microphones 300(*a*), 300(*b*), . . . 300(*n*). A single microphone 300(*x*) is shown for convenience in FIG. 1.

The head unit 100 may serve to control overall operations of a vehicle audio system. In the present exemplary embodiment, the head unit 100 may control the external amplifier 200 to generate a signal for removing noise generated in the vehicle. The external amplifier 200 will be described below in detail.

The active noise control apparatus 10 for a vehicle may offset noise using the wave superposition principle. The microphones 300(*a*), 300(*b*), . . . 300(*n*) for analyzing the waveform of sound may be mounted at positions where noise can be generated, and the external amplifier 200 may output a signal for removing noise analyzed through the microphones 300(*a*), 300(*b*), . . . 300(*n*), thereby offsetting the noise generated in the vehicle.

Because a method for implementing active noise control is already known, the detailed descriptions thereof are omitted herein.

The external amplifier 200 may supply power required for operations of the plurality of microphones 300(*a*), 300(*b*), . . . 300(*n*), and output a signal for removing noise according to the control of the head unit 100.

In the present exemplary embodiment, the external amplifier 200 may include a power supply unit 210, a digital signal processor (DSP) 230, and a master communication unit 250.

The power supply unit 210 may store power required for operations of the plurality of microphones 300(*a*), 300(*b*), . . . , 300(*n*), which will be described below. Specifically, the power supply unit 210 may include a phantom power which supplies electricity to a device, which needs to receive power in the sound system, through a cable.

The DSP 230 may process electrical signals generated through the plurality of microphones 300(*a*), 300(*b*), . . . , 300(*n*), in order to output a signal for removing noise generated in the vehicle.

The master communication unit 250 may supply power of the power supply unit 210 to the plurality of microphones 300(*a*), 300(*b*), . . . , 300(*n*), and transmit the electrical signals received from the plurality of microphones 300(*a*), 300(*b*), . . . , 300(*n*) to the DSP 230.

In the present exemplary embodiment, the master communication unit 250 may exchange data and control signals with the microphones 300(*a*), 300(*b*), . . . 300(*n*) while communicating with the plurality of microphones 300(*a*), 300(*b*), . . . 300(*n*) through serial signal transmission.

That is, the external amplifier 200 may not communicate with any one microphone 300(*i*) corresponding one-to-one to the external amplifier 200 through parallel signal transmission, but instead communicates with the microphones 300(*a*), 300(*b*), . . . 300(*n*) which are sequentially connected to the external amplifier 200 through the serial signal transmission. Thus, a wiring harness for connecting the external amplifier 200 to the microphones 300(*a*), 300(*b*), . . . 300(*n*) can be reduced in length and weight.

Figure 2A:
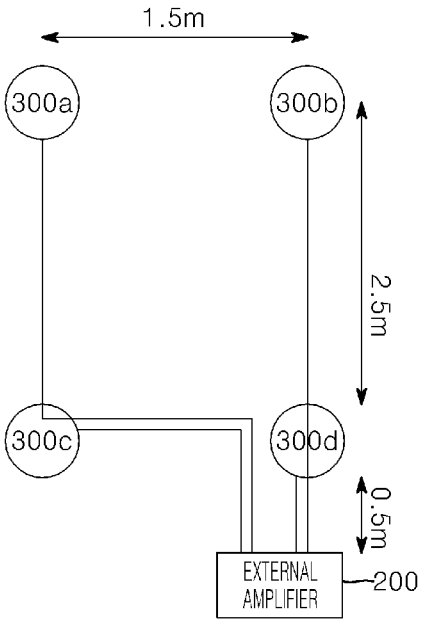
FIG. 2A (PRIOR ART)
FIGS. 2A and 2B are diagrams respectively illustrating a connection state of a wiring harness of a conventional active noise control apparatus and a connection state of the wiring harness of the active noise control apparatus for a vehicle in accordance with an exemplary embodiment of the present invention.
Figure 2B:
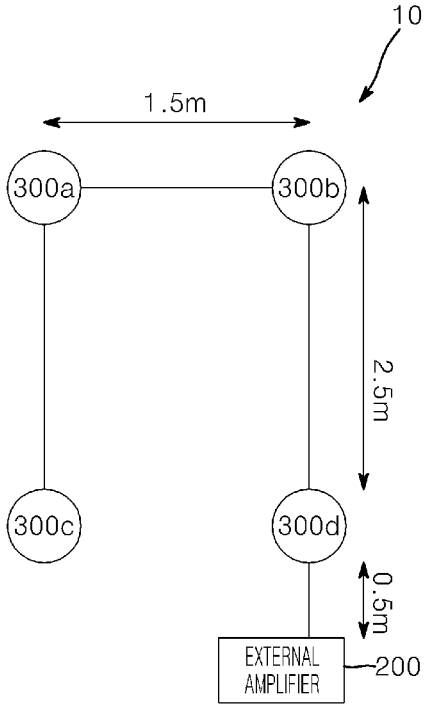

FIGS. 2A and 2B are diagrams respectively illustrating a connection state of a wiring harness of the conventional active noise control apparatus and a connection state of the wiring harness of the active noise control apparatus 10 for a vehicle in accordance with an exemplary embodiment of the present invention.

FIG. 2A is a diagram illustrating the connection state of the wiring harness in the conventional active noise control apparatus for a vehicle, and FIG. 2B is a diagram illustrating the connection state of the wiring harness in the active noise control apparatus 10 for a vehicle in accordance with an exemplary embodiment of the present invention.

As illustrated in FIG. 2A, the conventional active noise control apparatus for a vehicle includes an external amplifier 200 and microphones 300(*a*), 300(*b*), . . . 300(*n*) which are connected in parallel to each other. For example, FIG. 2A shows four microphones 300(*a*), 300(*b*), 300(*c*), and 300(*d*) connected in parallel. Thus, the wiring harness has a relatively large length, and the number of microphones connected to the external amplifier is inevitably limited.

Furthermore, as illustrated in FIG. 2A, the microphones 300(*i*) of the conventional active noise control apparatus for a vehicle each require a separate wiring harness for receiving power from a vehicle battery. Thus, as the total length of the wiring harness is increased, the total weight of the wiring harness is inevitably increased.

On the other hand, as illustrated in FIG. 2B, the plurality of microphones 300(*a*), 300(*b*), . . . 300(*n*) in accordance with the present exemplary embodiment are connected in series to the external amplifier 200. Thus, the total length of the wiring harness can be reduced.

Furthermore, because the plurality of microphones 300(*a*), 300(*b*), . . . 300(*n*) are connected in series to the external amplifier 200, the number of the microphones can be expanded regardless of the number of ports included in the external amplifier 200 in the active noise control apparatus 10 for a vehicle in accordance with an exemplary embodiment of the present invention.

Figure 3A:
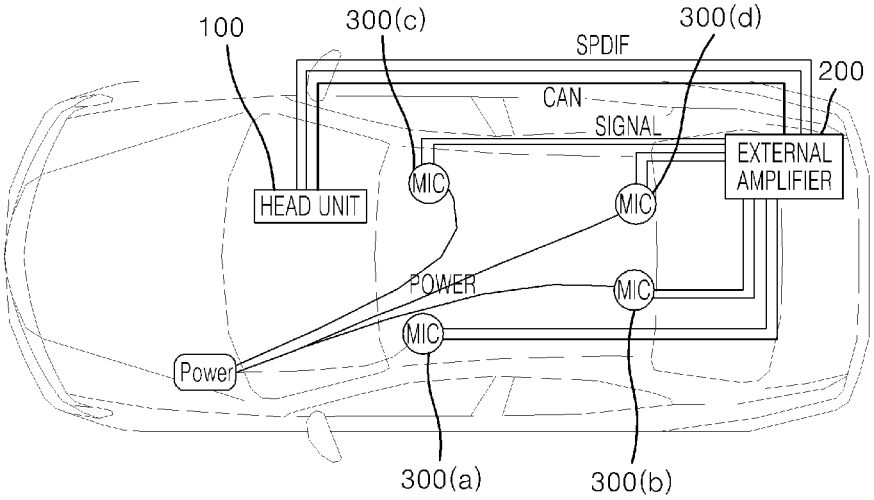
FIG. 3A (PRIOR ART)
FIGS. 3A and 3B are diagrams respectively illustrating a difference in length between the wiring harness of the conventional active noise control apparatus for a vehicle and the wiring harness of the active noise control apparatus for a vehicle in accordance with an exemplary embodiment of the present invention.
Figure 3B:
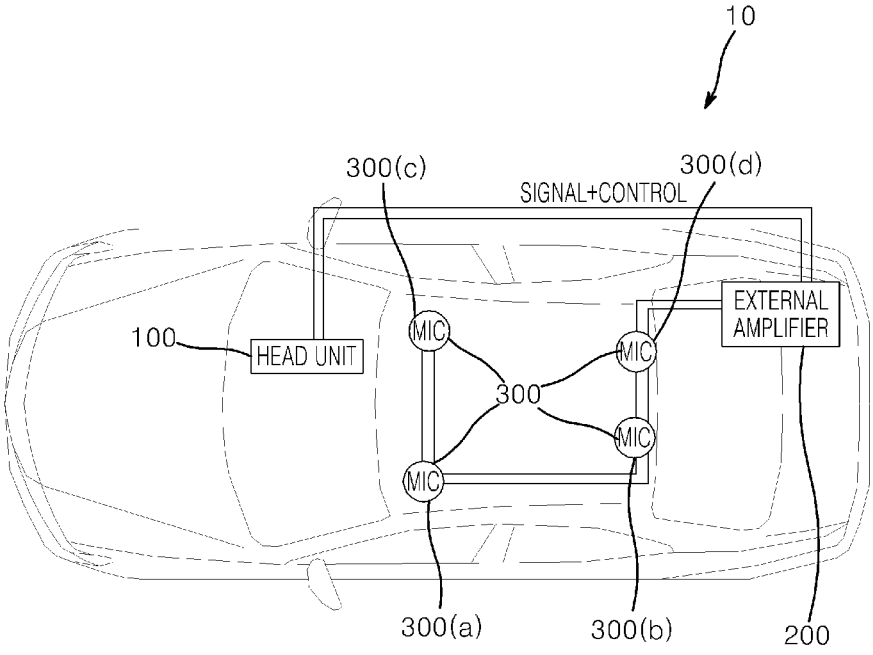

FIGS. 3A and 3B are diagrams respectively illustrating a difference in length between the wiring harness of the conventional active noise control apparatus for a vehicle and the wiring harness of the conventional active noise control apparatus 10 for a vehicle in accordance with an exemplary embodiment of the present invention.

Table 3 comparatively shows the length of the wiring harness of the active noise control apparatus 10 for a vehicle in accordance with an exemplary embodiment of the present invention and the length of the wiring harness of the conventional active noise control apparatus.

TABLE 1

| Distance to external amplifier | Conventional apparatus | Present invention |
|---|---|---|
| First microphone 300a | 4.5 m | 1.5 m |
| Second microphone 300b | 3 m | 2.5 m |

TABLE 1-continued

| Distance to external amplifier | Conventional apparatus | Present invention |
|---|---|---|
| Third microphone 300c | 2 m | 2.5 m |
| Fourth microphone 300d | 0.5 m | 0.5 m |
| Total Length | 11 m | 6 m |

In the conventional active noise control apparatus, the external amplifier 200 and the microphones 300(*a*), 300(*b*), 300(*c*), and 300(*d*) are connected in parallel to each other. Thus, as shown in Table 1, the length of a wiring harness for connecting the external amplifier to the most remote microphone is set to 4.5 meters, and the length of the entire wiring harness is set to 11 meters.

On the other hand, in the active noise control apparatus for a vehicle in accordance with an exemplary embodiment shown in FIG. 3B, illustrating four microphones, for example, the plurality of microphones 300(*a*), 300(*b*), 300(*c*), and 300(*d*) are connected in series to the external amplifier 200. Thus, the total length of the wiring harness can be significantly reduced.

Specifically, while the conventional active noise control apparatus requires the wiring harness with a length of 11 meters, the active noise control apparatus 10 in accordance with the example illustrated in FIGS. 2B and 3B may connect the same number of microphones 300(*a*), 300(*b*), 300(*c*), and 300(*d*) to the external amplifier 200 through the wiring harness with a length of only 6 meters.

The microphones 300(*i*) may receive noise generated from the vehicle, and generate an electrical signal corresponding to the noise.

Specifically, each of the microphones 300(*i*) may include a converter 310 and a slave communication unit 330, as shown in FIG. 1. The converter 310 may convert noise generated in the vehicle into an electrical signal, and the slave communication unit 330 may exchange signals with the master communication unit 250 of the external amplifier 200.

Figure 4:
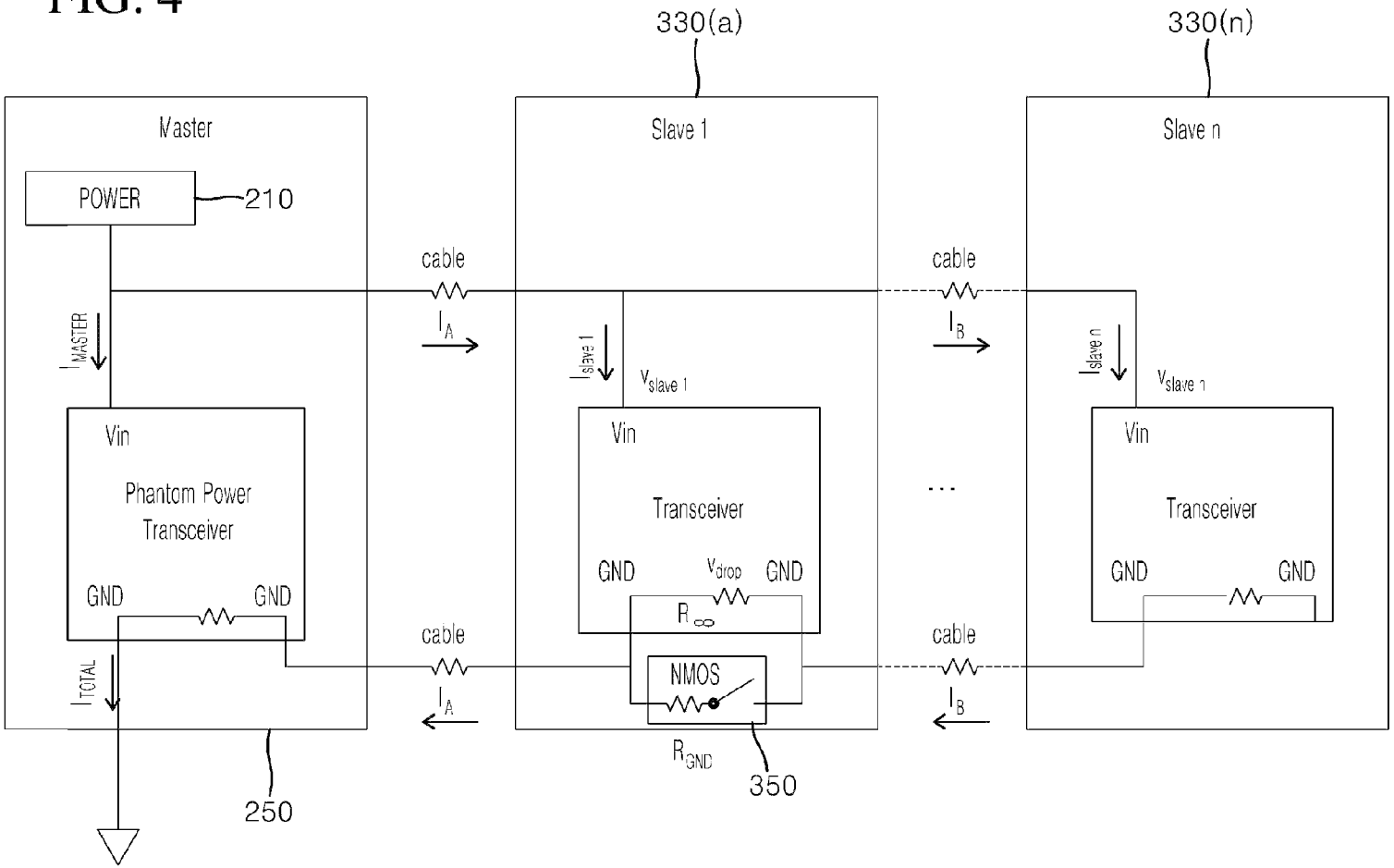
FIG. 4 is a diagram illustrating a current flow of the active noise control apparatus for a vehicle in accordance with an exemplary embodiment of the present invention.

In particular, the microphones 300(*i*) in accordance with the present exemplary embodiment may further include a switch 350 connected in parallel to an internal ground resistance $R_{GND}$ of the slave communication unit 330, as shown in FIG. 4, and thus, reduce a voltage drop which occurs when a current flowing through the microphones 300(*i*) connected in series to each other passes through the internal ground resistance of the slave communication unit 330.

That is, when a signal is transmitted through the serial signal transmission, a voltage drop may occur while the signal passes through the internal ground resistance $R_{GND}$ of the slave communication unit 330. As the number of microphones 300(*x*) connected in series increases, the number of internal ground resistances $R_{GND}$ through which the signal passes also increases. Thus, a voltage drop may increase.

Thus, in the present exemplary embodiment, the internal ground resistance $R_{GND}$ of the slave communication unit 330 may be connected in parallel to the switch 350, thereby reducing the magnitude of combined resistance.

Specifically, in the present exemplary embodiment, the switch 350 may include an NMOSFET (N-type Metal Oxide Semiconductor Field Effect Transistor), and a GPIO (General Purpose Input Output) of the head unit 100, and the gate of the NMOSFET may be connected to turn on or off the switch 350 according to a signal applied to the gate. Specifically, the slave communication unit 330 may receive an on/off signal through a control interface of the master communication unit 250, and control the GPIO according to the corresponding signal.

That is, when the NMOSFET is turned on, the resistance between the drain and source is several tens of mΩ, which is a considerably smaller than the internal ground resistance $R_{GND}$ of the slave communication unit 330. Thus, the combined resistance based on the parallel connection between the slave communication unit 330 and the switch 350 may become several tens of mΩ, which is similar to the resistance between the drain and source of the NMOSFET, thereby reducing a voltage drop while a current passes through the combined resistance.

In particular, the head unit 100 may determine to turn on or off the switch 350, based on the number of the microphones 300(*i*) connected in series or the current consumption of the microphones 300(*i*).

Specifically, the head unit 100 may turn on the switch 350, when the number n of the microphones 300(*i*) connected in series to each other exceeds a preset reference number, or the current consumption of the microphones 300(*i*) exceeds a preset reference current.

At this time, the reference number and the reference current may be set to the maximum number and the maximum current consumption of the microphones 300(*i*), at which a voltage drop can be generated within a range in which the active noise control apparatus for a vehicle can normally operate.

That is, when a number n of microphones 300(*i*), which generates a voltage drop to such an extent that the active noise control apparatus cannot normally operate, are connected to each other, or the microphones 300(*i*) consume such an amount of current that the active noise control apparatus cannot normally operate, the head unit 100 may turn on the switch 350 to reduce a voltage drop.

FIG. 4 is a diagram illustrating a current flow of the active noise control apparatus for a vehicle in accordance with an exemplary embodiment of the present invention.

Referring to FIG. 4, a total current $I_{total}$ supplied to the plurality of microphones 300(*a*), 300(*b*), . . . 300(*n*) from the power supply unit 210 of the external amplifier 200 may be expressed as Equation 1 below.

$$I_{total}=I_{master}+I_A \quad \text{Equation 1}$$

Furthermore, a current $I_A$ flowing through the slave communication units 330(*a*), 330(*b*), . . . 330(*n*) of all of the microphones 300(*a*), 300(*b*), . . . 300(*n*), including a cable loss, may be expressed as Equation 2 below.

$$I_A=I_B+I_{slave1} \quad \text{Equation 2}$$

Furthermore, a current $I_B$ flowing through the slave communication units 330(*b*), . . . 330(*n*) of the second to n-th microphones 300(*b*), . . . 300(*n*) may be expressed as Equation 3 below.

$$I_B=I_{slave2}+I_{slave3}+\ldots+I_{slaven} \quad \text{Equation 3}$$

Furthermore, when the current $I_B$ passes through the slave communication units 330(*a*), 330(*b*), . . . 330(*n*) of the microphones 300(*a*), 300(*b*), . . . 300(*n*) connected in series, a voltage drop may occur in the internal ground resistances $R_{GND}$ of the slave communication units 330(*a*), 330(*b*), . . . 330(*n*).

At this time, a total voltage drop $V_{drop}$ occurring in the internal ground resistances $R_{GND}$ of the slave communication units 330(*a*), 330(*b*), . . . 330(*n*) may be calculated as Equation 4 below.

$$V_{drop}=I_B\times R_{GNL} \quad \text{Equation 4}$$

Furthermore, as the number of the connected microphones 300(*a*), 300(*b*), . . . 300(*n*) increases, the current $I_B$ increases. Thus, as the number of the connected microphones 300(*a*), 300(*b*), . . . 300(*n*) increases, the total voltage drop may also increase.

Thus, in the present exemplary embodiment, the switch 350 may be connected in parallel to the internal ground resistance RGND of the slave communication unit 330(*i*), thereby reducing the combined resistance and the entire voltage drop.

In accordance with the present exemplary embodiment, as the microphones and the external amplifier are connected in series to each other, the number of microphones can be expanded regardless of the number of external amplifiers. Thus, noise generated in the vehicle can be effectively collected and removed.

Furthermore, the internal resistances of the microphones may be connected in parallel to the switch so as to reduce the combined resistance of the entire microphones. Thus, as the signals of the microphones and the external amplifier are exchanged through the serial signal transmission, a voltage drop which can occur in the microphones may be reduced to improve the current efficiency.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An active noise control apparatus for a vehicle, comprising:

a plurality of microphones each configured to receive noise generated in the vehicle and generate an electrical signal corresponding to the noise;

an external amplifier configured to supply power required for operations of the plurality of microphones; and a head unit configured to control the external amplifier to output a signal for removing the noise, based on the electrical signals generated from the plurality of microphones, wherein:

the external amplifier comprises:

a power supply unit;

a digital signal processor (DSP) configured to process the electrical signals generated from the plurality of microphones, in order to output the signal for removing the noise; and a master communication unit configured to supply power of the power supply unit to the plurality of microphones, and transmit the electrical signals received from the microphones to the DSP; and each of the microphones comprises:

a converter configured to convert the noise generated in the vehicle into an electrical signal:

a slave communication unit configured to exchange signals with the master communication unit; and a switch connected in parallel to internal ground resistance of the slave communication unit.

2. The active noise control apparatus of claim 1, wherein the master communication unit is configured to communicate with the plurality of microphones through serial signal transmission.

3. The active noise control apparatus of claim 1, wherein the switch comprises an N-type Metal Oxide Semiconductor Field Effect Transistor (NMOSFET).

4. The active noise control apparatus of claim 1, wherein the plurality of microphones and the external amplifier are connected in series to each other.

5. The active noise control apparatus of claim 4, wherein the head unit is configured to determine to turn on or off the switch, based on the number of the microphones connected in series to each other or the current consumption of the microphones.

6. The active noise control apparatus of claim 5, wherein the head unit is configured to turn on the switch when the number of the microphones connected in series to each other exceeds a preset reference number.

7. The active noise control apparatus of claim 5, wherein the head unit is configured to turn on the switch when the current consumption of the microphones connected in series to each other exceeds a preset reference current.

* * * * *